US008328035B2

(12) United States Patent
Safir

(10) Patent No.: US 8,328,035 B2
(45) Date of Patent: Dec. 11, 2012

(54) BAGGAGE CONTAINER

(75) Inventor: André Safir, Garches (FR)

(73) Assignee: SBS (FR)

( * ) Notice: Subject to any disclaimer, the term of this patent is extended or adjusted under 35 U.S.C. 154(b) by 483 days.

(21) Appl. No.: 12/670,161

(22) PCT Filed: Jul. 23, 2008

(86) PCT No.: PCT/FR2008/001087

§ 371 (c)(1),
(2), (4) Date: Jan. 22, 2010

(87) PCT Pub. No.: WO2009/044004

PCT Pub. Date: Apr. 9, 2009

(65) Prior Publication Data

US 2010/0187064 A1 Jul. 29, 2010

(30) Foreign Application Priority Data

Jul. 24, 2007 (FR) ..... 07 05380

(51) Int. Cl.
*B65D 21/02* (2006.01)

(52) U.S. Cl. ..... 220/23.89; 220/1.5; 220/23.88; 190/15.1

(58) Field of Classification Search ..... 220/1.5, 220/23.88, 23.89; 190/15.1; 248/346.02, 248/346.5; 410/46, 67, 77, 78, 80, 84, 87, 410/88

See application file for complete search history.

(56) References Cited

U.S. PATENT DOCUMENTS

| | | | | |
|---|---|---|---|---|
| D217,232 | S * | 4/1970 | Meller et al. | D3/272 |
| 3,594,055 | A * | 7/1971 | Lohr et al. | 312/215 |
| 6,047,588 | A * | 4/2000 | Danilychev | 73/23.2 |
| 2003/0223838 | A1 | 12/2003 | Looker | |

FOREIGN PATENT DOCUMENTS

| | | | |
|---|---|---|---|
| DE | 10 2005 051987 | A1 | 5/2007 |
| FR | 2 870 208 | A | 11/2005 |
| FR | 2 876 254 | A | 4/2006 |
| WO | WO 2006/040421 | A2 | 4/2006 |

OTHER PUBLICATIONS

International Search Report dated Apr. 20, 2009, issued in corresponding international application No. PCT/FR2008/001087.

* cited by examiner

*Primary Examiner* — Harry Grosso
(74) *Attorney, Agent, or Firm* — Ostrolenk Faber LLP

(57) ABSTRACT

The present disclosure relates to a baggage container with at least one loading platform for single items of hand baggage, said baggage items each having a base on which are two opposed lateral walls, said loading platform comprising reception methods for each base of said items of baggage in order to receive said items of baggage standing on the base thereof and organized such that said walls of said items of baggage are essentially parallel to each other. According to the disclosure, said reception methods have ways for holding each of said bases and said bases are designed to engage in said reception methods when the item of baggage is loaded into the container, such that said bases cooperate with said retainer methods to hold the item of baggage in a fixed opposition on said loading platform.

15 Claims, 2 Drawing Sheets

BAGGAGE CONTAINER

CROSS REFERENCE TO RELATED APPLICATIONS

The present application is a 35 U.S.C. §371 National Phase conversion of PCT/FR2008/001087, filed Jul. 23, 2008, which claims benefit of French Application No. 0705380, filed Jul. 24, 2007, the disclosure of which is incorporated herein by reference. The PCT International Application was published in the French language.

The present invention relates to a luggage container designed for the automatic handling and routing of items of luggage.

One envisaged field of application is in particular that of air transport for which it is necessary to transfer individual items of hand luggage between an air terminal and the hold of an aircraft. The items of luggage are usually of parallelepipedal shape and they have a base surmounted by two opposite lateral sides spaced at a distance corresponding to the thickness of the item of luggage.

For the purpose of increasing the turnaround rate of the aircraft, it is necessary for the transfer of the items of luggage between the aircraft and the air terminal to be carried out in the shortest possible time and with means that are as low-cost as possible.

Also, installations comprising a storage frame have been conceived, the items of luggage being stored manually resting on their base and in rows, for example by the luggage porters themselves. In this way, the items of luggage are stored rationally and manually, in order to be able to be subsequently handled in an automatic manner without human intervention, and in particular so as to be transferred into the hold of the aircraft in rows, after the storage frame has been carried to the aircraft by means of a motor vehicle.

Moreover, the items of luggage are easily taken out by the operators themselves, after the automatic transfer in rows, this time from the hold to another identical storage frame, after the plane has landed.

Reference may be made in particular to document WO2006040421, which describes such an installation.

However, a first drawback of this installation results from the relative movement of the items of luggage on the storage frame when it is towed, particularly by the motor vehicle. Another drawback lies in the security that surrounds the transfer of luggage, and in particular the possibility that a luggage porter can take an item of luggage or substitute one from the storage frame.

Also, a problem that arises and that the present invention aims to solve is to provide a luggage container that makes it possible not only to reserve a determined space for storing each item of luggage and prevent it being towed in movement during the transfers, but also which allows a single identified luggage porter to store or withdraw his item of luggage in and from said determined space.

For the purpose of solving this problem, the present invention proposes, according to a first aspect, a luggage container comprising at least one platform for loading individual items of hand luggage, said items of luggage having respectively a base surmounted by two opposite lateral sides, said loading platform comprising means for receiving each of the bases of said items of luggage in order to receive said items of luggage resting on their base and in rows so that said sides of said items of luggage are substantially parallel with one another; according to the invention, said receiving means comprise means for retaining each of said bases; and said bases are suitable for being engaged in said retaining means when said item of luggage is loaded into said container so that said bases interact with said retaining means in order to keep said item of luggage in a fixed position on said loading platform.

Therefore, a feature of the invention lies in the method of connecting the items of luggage and the loading platform by virtue of the cooperation of shape of the base of the items of luggage and of the retaining means, which method then makes it possible to secure each item of luggage to said loading platform. In this way, during the transfer of the luggage, and more precisely during movements of the loading platform, the items of luggage remain coupled to the latter and no longer risk escaping therefrom, both during the transfer and during the flight in the aircraft hold.

The container that is the subject of the invention comprises, according to a particular embodiment of the invention, two superposed platforms, one of great width placed on the other of lesser width.

Moreover, since said loading platform has a bottom wall, said receiving means are arranged on portions of said bottom wall, which portions are in particular suitable for receiving said resting bases. According to one embodiment of the invention that is particularly advantageous, said receiving means have lateral guidance means for guiding the base of said items of luggage in translation in a given direction when said item of luggage is loaded into said container. In this way, each of the spaces reserved for the items of luggage is determined so that the alignment in rows of the items of luggage takes place without difficulty as the luggage porters load their items of luggage onto the loading platform.

Moreover, said loading platform advantageously has a rectilinear free loading edge which extends in a manner that is substantially perpendicular to said given direction. In addition, said lateral guidance means preferably comprise guidance section pieces installed on said bottom wall respectively at a distance from one another and parallel to said given direction. In this way, the items of luggage are loaded onto the loading platform so that one end of their base is engaged between two consecutive section pieces, in the vicinity of the free loading edge, and then the item of luggage is pulled manually in translation by the porter in said given direction, thanks to the guidance of the base by the guidance section pieces. Moreover, since the bases of said items of luggage have a width l and a length L, said guidance section pieces are advantageously spaced at a distance d that is substantially equal to said width l of said bases, and preferably at a distance d slightly greater than the width l in order to arrange a functional clearance allowing the base to slide between the section pieces.

According to a particularly advantageous embodiment of the invention, said retaining means comprise retaining wings installed as a return on said guidance section pieces facing said bottom wall so as to form a U-shaped housing, while the bases of said items of luggage having coupling wings which extend laterally to come into engagement in said U-shaped housing, beneath said retaining wings. In this way, and as will be explained in detail in the rest of the description, the base, and consequently the item of luggage, is secured to the loading platform.

According to this embodiment, said retaining wings are preferably oriented toward one another on the guidance section pieces taken two by two. Therefore, two consecutive guidance section pieces have respectively two retaining wings facing one another under which two opposite coupling wings of the base are fitted to come respectively into engagement. In this way, the item of luggage has only one degree of freedom relative to the loading platform in said given direction. Also, said retaining means advantageously comprise immobilization locks installed on said guidance section pieces in order to immobilize said bases in said receiving means. Thus, the items of luggage are totally secured to the loading platform and no longer have any degree of freedom relative to it. Preferably, said locks comprise a bolt that can be retracted, for example by tilting, and a mechanism for immobilizing said bolt, said bolt being suitable to protrude laterally from said guidance section piece. Advantageously, said mechanism for immobilizing said bolt is a combination lock, so as to allow the immobilization lock to be unlocked only by the carrier of the combination. In this way, not only can the item of luggage be loaded into the container, in a location reserved in advance, only if the luggage porter knows the combination but also, conversely, the luggage can be recovered only by a person knowing said combination and, a priori, the porter of the luggage himself or a third party to whom he has communicated said combination. Thus, the security conditions that surround the transfer of the luggage are assured.

According to another aspect, the present invention proposes an individual item of hand luggage designed to be loaded into a luggage container as described above.

Other particular features and advantages of the invention will emerge on reading the following description of a particular embodiment of the invention, given as an indication and in no way limiting it, with reference to the appended drawings in which.

Figure 1:
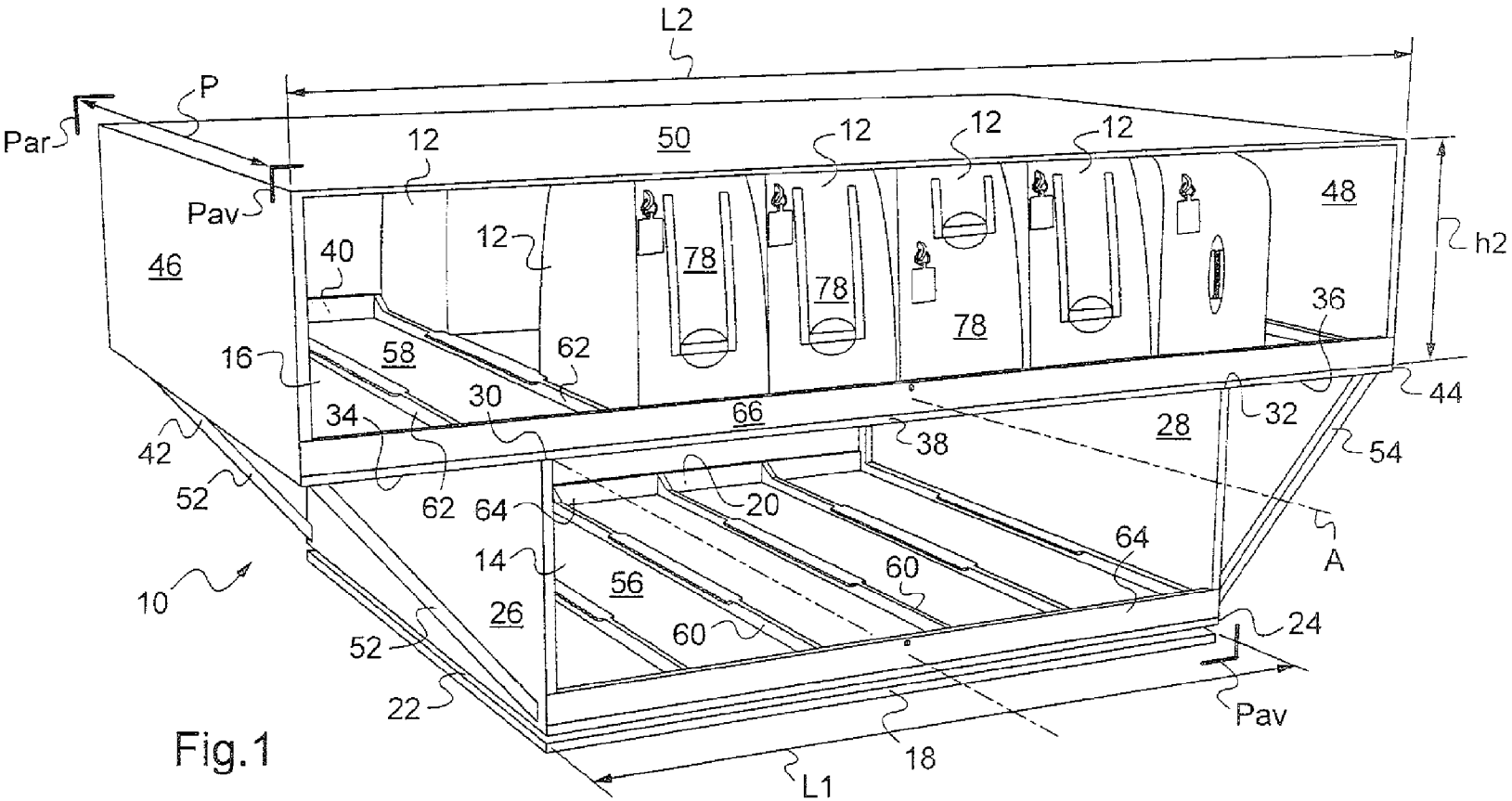
FIG. 1 is a schematic view in perspective of a luggage container according to the invention.

FIG. 1 shows in perspective a container 10 for luggage 12 according to the invention. This container 10 has two platforms for loading items of luggage 12, a lower platform 14 and an upper platform 16. The container 10 is of generally tubular shape with an axis of symmetry A, and it is suitable for being loaded into the hold of an aircraft not shown, so that its axis of symmetry A extends substantially parallel to the longitudinal axis of said aircraft. Said hold is designed to receive a plurality of containers 10 in line with one another so that their axes of symmetry A are substantially indistinguishable.

Therefore, it will be considered that the lower platform 14 has a first width L1 and the upper platform 16 has a second width L2 greater than the first in a direction perpendicular to the axis of symmetry A of the container 10 although, in the direction of this axis of symmetry A, the container 10 has a depth P lying between a front plane Pav and a rear plane Par, said depth P being similar to a length which is smaller than the aforementioned widths L1 and L2. Specifically, the first width L1 is preferably between 125 cm and 170 cm, for example 160 cm and the second width L2 preferably between 230 cm and 270 cm, for example 250 cm, while the depth P of the container 10 is advantageously between 100 cm and 150 cm, for example 125 cm.

The lower platform 14 is therefore of rectangular shape; it has two first opposite free loading edges, one of them 18, at the front of the figure, the other 20 at the rear of the figure, and two first opposite lateral edges 22, 24 respectively surmounted by two first opposite and rectangular vertical walls 26, 28. These two first vertical walls 26, 28 have a length that is substantially equivalent to the depth P of the container 10 and a height h1 preferably of between 40 and 60 cm, for example 50 cm.

These first vertical walls 26, 28 also and respectively have two upper rims 30, 32 on which the upper platform 16 rests. This upper platform 16 then overhangs the lower platform 14; having a second width L2 greater than the first width L1 of the lower platform 14, it is adjusted on the latter so that its two opposite ends 34, 36 extend respectively beyond the lower platform 14 and on each side, by a substantially equivalent distance, for example, of 45 cm.

The upper platform 16 has two second opposite free loading edges, 38, 40 and two second opposite lateral edges 42, 44 respectively surmounted by two second opposite and rectangular vertical walls 46, 48. They also have a length equivalent to the depth P of the container 10 and a height h2 equal to h1, for example of 50 cm. They are connected together, in their upper portion, by a ceiling wall 50 which overhangs the upper platform 16, in this instance at a distance of approximately 50 cm.

However, it will be observed that the second opposite vertical walls 46, 48 and the ceiling wall 50 which connects them are not absolutely necessary in all circumstances. They may in particular not be installed when the user is forced to stack the containers so as to occupy the smallest possible space.

Moreover, the lower platform 14 and the upper platform 16 are connected together by oblique lateral arms 52, 54 which extend respectively between the first and second opposite lateral edges 22, 42; 24, 44, so as to stiffen the container 10. According to an embodiment not shown of the luggage container according to the invention, provision is made to connect together the lower platform 14 and the upper platform 16 by retractable arms. More precisely, these arms are suitable to be folded so as to be able to extend between the two platforms 14, 16 while the latter are brought closer together in order to rest against one another. In this manner, luggage containers can be stored and stacked on one another while occupying a space that is reduced and less bulky than a nonretractable container.

As will be explained in greater detail in the rest of the description, the lower platform 14 and upper platform 16 respectively have bottom walls 56, 58 on which guidance section pieces 60, 62 are installed. In addition, they are respectively fitted with foldable flaps 64, 66 mounted articulated along said free edges 18, 38.

Figure 2:
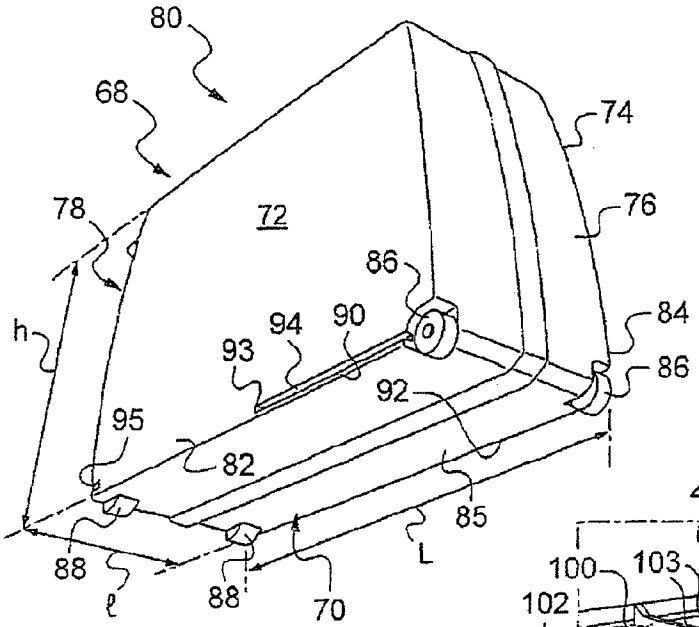
FIG. 2 is a schematic view in perspective of an item of luggage designed to be installed in the luggage container shown in FIG. 1.

Before that, a description will be given with reference to FIG. 2 of an individual item of hand luggage 68 suitable for being installed on the lower platform 14 or upper platform 16 of the aforementioned container 10 and for which protection is also sought.

The individual item of hand luggage 68 has a base 70 surmounted by two opposite lateral sides 72, 74 and two opposite rim walls 76, 78 joining a gripping wall 80. The base 70 is substantially rectangular and it has a width l and a length L. The width l is advantageously between 25 and 35 cm, for example 28 cm and the length between 40 cm and 100 cm, while the height h of the individual item of luggage 68 is less than 50 cm.

The base 70 has two opposite lateral borders 82, 84 and is fitted, on a bottom wall 85, on the side of one of the rim walls 76, with two rollers 86, and on the other side with two resting pads 88.

It will be seen that the two rollers 86 are respectively mounted recessed into the opposite lateral sides 72, 74 toward the inside of the base 70. Also, the base 70 has, on each of the opposite lateral borders 82, 84 coupling wings 90, 92 formed by means of a lateral groove 94 made in the opposite lateral borders 82, 84. This lateral groove 94 is made over a length that is substantially equal to half of the length L of the base 70, at a constant distance from the bottom wall 85, and it extends from a rest stop 93 up to said one of the rim walls 76 at which it emerges at the rollers 86. At the other end from the rollers 86, in line with the lateral groove 94 and close to the other rim wall 78, the opposite lateral borders 82, 84 respectively have an immobilization recess 95. It will be noted that the distance that separates the immobilization recess 95 and the rest stop 93 is determined. An explanation will be given in greater detail, with reference to FIG. 3, on the one hand of the functions of the coupling wings 90, 92 and the manner in which they interact with the lateral grooves 94 and the rest stop 93 and, on the other hand, the functionality of these immobilization recesses 95.

Moreover, according to an embodiment of the invention not shown, the base is mounted removably on the individual items of hand luggage. Thus, the items of luggage that are not fitted with a base as described above, when they are presented in the air terminal before embarkation, could be fitted with such a removable base just before they are checked in. In this manner, the item of luggage thus fitted can be inserted like the other individual items of hand luggage into the container according to the invention.

Figure 3:
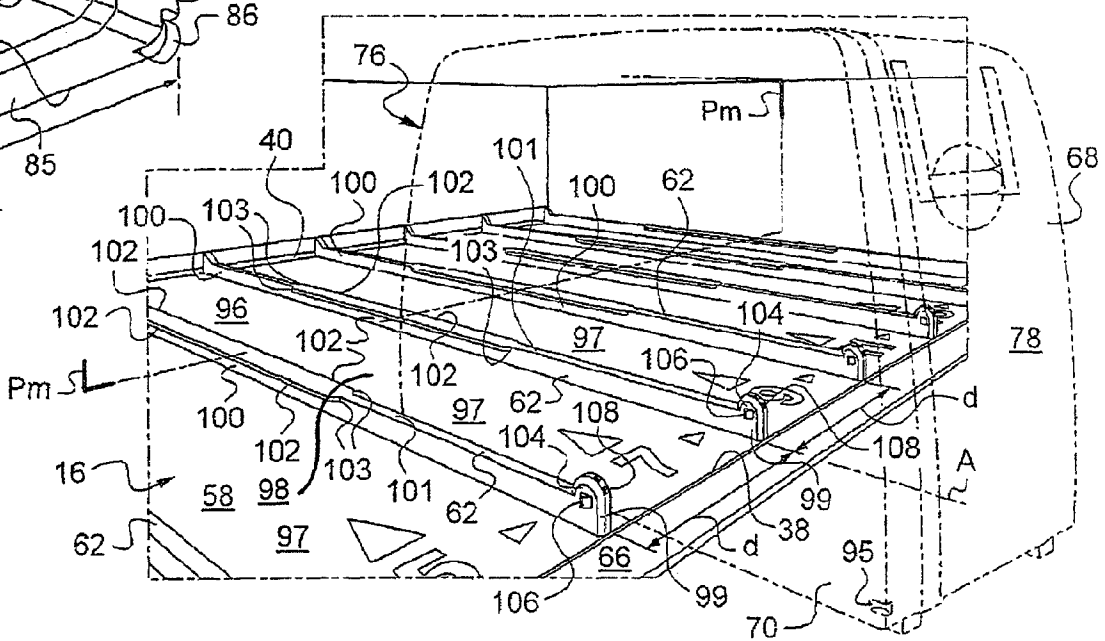
FIG. 3 is a partial schematic view of detail in perspective of the container shown in FIG. 1.

Reference is now made to FIG. 3 showing in perspective the details of the upper platform 16. Naturally, the two platforms 14, 16 comprise the same detail elements. Note that the container 10 has two portions 96, 98 that are symmetrical with one another relative to a midplane Pm perpendicular to the axis of symmetry A of the container 10 and which bisects it at equal distance from the opposite free edges 18, 20; 38, 40 of the lower platform 14 and upper platform 16. Moreover, note also that the fold-down flap 66 extends in this instance in a folded-down position in the plane of the bottom wall 58.

This FIG. 3 shows the bottom wall 58 of the upper platform 16 on which are installed the guidance section pieces 62 which extend parallel with one another and in the direction of the axis of symmetry A, from one free edge 38 to the other opposite free edge 40. Naturally, these guidance section pieces 62 are installed in a manner identical to that in which the guidance section pieces 60 are installed on the lower platform 14.

Thus, the guidance section pieces 62 are installed at a distance d, from one another, equivalent to the width l of the base 70 of each of the items of luggage 68, and more precisely at a slightly greater distance in order to obtain a reception space 97 providing a functional sliding clearance of the base 70 between the section pieces 62 and in a direction parallel to the axis of symmetry A.

Moreover, the section pieces 62 have a rear portion 100 situated in the vicinity of the midplane Pm, on the opposite side a front free end 99, and an upper edge 101. The section pieces 62 are fitted with retaining wings 102 which extend transversely, in their rear portion 100, from their upper edge 101, as a return and facing the bottom wall 58. In addition, these retaining wings 102 terminate longitudinally in a bearing end 103 oriented toward the front free end 99 and at a given distance from this front free end 99.

Two consecutive section pieces 62 thus have, in their rear portion 100, retaining wings 102 oriented toward one another so as to form two U-shaped housings facing one another.

In this way, the item of luggage 68 shown in FIG. 3 in a transparent manner for the requirements of the description is partially engaged between two section pieces 62, the rollers 86 in this instance being masked by the section pieces 62, and resting against the bottom wall 58. The section pieces 62 also mask the lateral groove 94 of the base 70.

The item of luggage 68 is designed to be driven in translation toward the rear portion 100 of the section pieces 62 so that the retaining wings 102 engage slidingly in the lateral grooves 94 of the base 70. In this manner, the base 70 is kept laterally engaged between the section pieces 62 and vertically by the retaining wings 102 which keep it resting against the bottom wall 58. On the other hand, the base 70 and consequently the item of luggage 68 are still free in translation in the direction of the axis of symmetry A.

In order to lock the item of luggage 68 onto the upper platform 16, by means of its base 70, the guidance section pieces 62 are fitted, in their front free end 99, with an immobilization lock 104 comprising a pivoting retractable bolt 106 and a combination mechanism 108 for immobilizing the retractable bolt 106. The combination immobilization mechanism 108 is in this instance a thumbwheel immobilization mechanism.

The retractable bolt 106 is installed at a determined distance from the bearing end 103 of the retaining wings 102, this determined distance corresponding exactly to the determined distance that separates the immobilization recess 95 and the rest stop 93 of the base 70. The retractable bolt 106 is also suitable for pivoting between an active position, in which it extends laterally protruding from the front free end 99 of the guidance section piece 62 and an inactive position in which it is retracted inside the immobilization lock 104 and recessed from the front free end 99 of the guidance section piece 62. Moreover, only one immobilization lock 104 is provided for each reception space 97, in order to immobilize the base 70 in said reception space 97. Thus, each of the front free ends 99 of the guidance section pieces 62 is fitted with an immobilization lock 104 furnished with a single retractable bolt 106.

Consequently, when the base 70 is engaged between the guidance section pieces 62, one of its lateral borders 84 pushes the retractable bolt 10 into the immobilization lock 104 provided, of course, that the correct combination of the immobilization lock 104 has been displayed. Then, the retractable bolt 106 returns to its active position, protruding laterally from the immobilization lock 104 when the item of luggage 68 has been driven in translation so that the rest stops 93 of the lateral grooves 94 have come to press against the bearing end 103 of the retaining wings 102 and thereby one of the immobilization recesses 95 is exactly opposite the retractable bolt 106.

Finally, after the combination of the immobilization lock 104 has been scrambled, the retractable bolt 106 remains in its active position protruding from the immobilization recess 95 and it forms a member for stopping the item of luggage 68 via the base 70. The latter is then also held in a fixed position in the direction of the axis of symmetry A and thus trapped by the platform 16. Consequently, the item of luggage 68 cannot be taken from it without again displaying the correct combination of the immobilization lock 104.

In addition, and as shown in FIG. 1, in which the fold-down flaps 64, 66 are in folded-down opposition, facing the other rim wall 78 of the items of luggage 68, the latter are totally trapped by the container 10. Because, in effect, even when the retractable bolt 106 is retracted, if there was an attempt to extract the items of luggage 68, they would butt against the fold-down flaps 64, 66 in their folded-down positions.

What is claimed is:

1. A luggage container comprising at least one platform for loading individual items of hand luggage, said items of luggage having respectively a base surmounted by two opposite lateral sides, said loading platform comprising means for receiving each of the bases of said items of luggage in order to receive said items of luggage resting on their base and in rows so that said sides of said items of luggage are substantially parallel with one another; characterized in that said receiving means comprise means for retaining each of said bases; and in that said bases are suitable for being engaged in said retaining means when said item of luggage is loaded into said container so that said bases interact with said retaining means in order to keep said item of luggage in a fixed position on said loading platform.

2. The luggage container as claimed in claim 1, wherein it comprises two superposed loading platforms.

3. The luggage container as claimed in claim 2, wherein it comprises a lower platform having a first width L1 and an upper platform (16) having a second width L2 greater than said first width L1.

4. The luggage container as claimed in claim 1, wherein, since said loading platform has a bottom wall, said receiving means are arranged on portions of said bottom wall.

5. The luggage container as claimed in claim 1, wherein said receiving means have lateral guidance means for guiding the base of said items of luggage in translation in a given direction when said item of luggage is loaded into said container.

6. The luggage container as claimed in claim 5, wherein said loading platform has a free loading edge which extends in a manner that is substantially perpendicular to said given direction.

7. The luggage container as claimed in claim 5, wherein said lateral guidance means comprise guidance section pieces installed on said bottom wall respectively at a distance from one another and parallel to said given direction and wherein said loading platform has a free loading edge which extends in a manner that is substantially perpendicular to said given direction.

8. The luggage container as claimed in claim 4 wherein said receiving means have lateral guidance means for guiding the base of said items of luggage in translation in a given direction when said item of luggage is loaded into said container and wherein said lateral guidance means comprise guidance section pieces installed on said bottom wall respectively at a distance from one another and parallel to said given direction.

9. The luggage container as claimed in claim 8, wherein, since the bases of said items of luggage have a width l and a length L, said guidance section pieces are spaced at a distance d that is substantially equal to said width l of said bases.

10. The luggage container as claimed in claim 8, wherein said retaining means comprise retaining wings installed as a return on said guidance section pieces facing said bottom wall, while the bases of said items of luggage having coupling wings which extend laterally to come into engagement beneath said retaining wings.

11. The luggage container as claimed in claim 10, wherein said retaining wings are oriented toward one another on the guidance section pieces taken two by two.

12. The luggage container as claimed in claim 8, wherein said retaining means comprise immobilization locks installed on said guidance section pieces in order to immobilize said bases in said receiving means.

13. The luggage container as claimed in claim 12, wherein said locks comprise a bolt that can be retracted and a mechanism for immobilizing said bolt, said bolt being suitable to protrude laterally from said guidance section piece.

14. The luggage container as claimed in claim 13, wherein said mechanism for immobilizing said bolt is a combination lock.

15. An individual item of hand luggage designed to be loaded into a luggage container as claimed in claim 1.

* * * * *